US007827995B2

(12) United States Patent
Chaoui

(10) Patent No.: US 7,827,995 B2
(45) Date of Patent: Nov. 9, 2010

(54) INTERLOCKING HOOKAH PIPE

(75) Inventor: Rani Chaoui, El Cajon, CA (US)

(73) Assignee: Inhale, Inc., Santee, CA (US)

( * ) Notice: Subject to any disclaimer, the term of this patent is extended or adjusted under 35 U.S.C. 154(b) by 494 days.

(21) Appl. No.: 11/974,160

(22) Filed: Oct. 10, 2007

(65) Prior Publication Data

US 2009/0095310 A1 Apr. 16, 2009

(51) Int. Cl.
*A24F 1/30* (2006.01)

(52) U.S. Cl. ..... 131/173; 131/225

(58) Field of Classification Search ..... 131/173, 131/225, 200

See application file for complete search history.

(56) References Cited

U.S. PATENT DOCUMENTS 722,405 A * 3/1903 Ganim ..... 131/173
4,133,318 A * 1/1979 Gross et al. ..... 131/173
4,223,686 A 9/1980 Murray, Jr. ..... 131/173
5,908,031 A 6/1999 Clark et al. ..... 131/173
6,568,400 B1 5/2003 Tinsky et al. ..... 131/173

* cited by examiner

*Primary Examiner*—Carlos Lopez
(74) *Attorney, Agent, or Firm*—Louis F. Teran

(57) ABSTRACT

An Interlocking Hookah Pipe is disclosed. The pipe incorporates a positively-lockable interface between the stem assembly and the base assembly of a hookah pipe. The interlocking stem assembly has an interlock element upon which are pins, channels or other interlocking features. The stem assembly further has a sealing gasket to seal to the base assembly. The base assembly includes a shoulder insert that inserts into the glass base jar and is then adhered thereto. The shoulder insert has interlocking features that cooperate with the interlocking features disposed on the stem assembly interlock element. The pins or channels creating the interlocking mechanism may be disposed on either the stem assembly or the shoulder insert.

14 Claims, 9 Drawing Sheets

INTERLOCKING HOOKAH PIPE

BACKGROUND OF THE INVENTION

1. Field of the Invention

This invention relates generally to smoking accessories and, more specifically, to an Interlocking Hookah Pipe.

2. Description of Related Art

Water pipes, and in particular, those decorative versions known as "hookah" pipes, have experienced a resurgence in popularity worldwide. An exemplary unit is depicted in FIG. 1.

FIG. 1 is a perspective view of a conventional hookah pipe 10. There are generally two sub-assemblies that make up the conventional hookah pipe 10: the base assembly 12 and the stem assembly 14. The base assembly 12 has a base jar 15 as its major component.

The stem assembly 14 has the bowl 16 for burning the tobacco product. The user places the mouthpiece 20 between his or her lips and sucks, which creates a suction on the hose 18 (pipes 10 can have more than a single user hose/mouthpiece also), and draws smoke from the bowl 16, into the water located in the base jar 15 and to the user through the hose 18 and mouthpiece 20. A throttle 22 is generally provided to add clean air to the stream being inhaled by the user; rotation of the throttle knob 24 will increase or decrease the amount of air introduced into the inhaled smoke stream. If we now turn to FIG. 2, we can continue to examine this prior art device.

FIG. 2 is a perspective view of the stem assembly 14 of the hookah pipe of FIG. 1. The major component of the stem assembly 14 is the stem housing 26. A bowl stem 30 extends out through the top end of the stem housing 26 and terminates in the bowl 16. Many times a charcoal plate 32 is provided between the bowl 16 and stem housing 26 to catch any ash dropped from the bowl 16. The bowl stem 30 actually extends through the stem housing 26 and out through the stem housing base 28 to form the water stem 34 and ultimately terminate in the bottom end 36, which is configured to be positioned just above the bottom of the base jar (see FIG. 1) when the pipe is completely assembled. The stem housing base 28 is generally a hollow section of the stem assembly 14 that is in fluid communication with the hose 18 and the throttle 22. The base 28 has holes on its bottom side (adjacent to the water stem 34) which draw smoke to bubble up through the water in the base jar.

The conventional device that keeps the stem assembly attached to the base assembly (see FIG. 1) is a sealing plug 38, which is more specifically disclosed in FIG. 3.

FIG. 3 is a perspective view of the sealing plug 38 of the pipe of FIGS. 1 and 2. The plug 38 is generally a body 40 formed from a solid piece of rubber (akin to a rubber cork). A stem bore 42 is formed through the body 40 to accept the water stem (see FIG. 2) therethrough. As should be apparent, the tapered outer surface of the body 40 is designed to snugly fit within the throat 48 formed within the base jar 15 as depicted in FIG. 4. The throat 48 is the path interconnecting the top opening 46 in the base jar 15 and the interior of the base jar 15. There is generally a shoulder 44, or thickened portion of the wall of the base jar 15 at the top of the base jar 15, around the perimeter of the top opening 46.

The sole element keeping the stem assembly (see FIG. 1) attached to the base assembly (see FIG. 1) is the sealing plug 38. Presumably, this construction is used because the water stem (see FIG. 2) is metal, while the base jar 15 is glass, plastic or ceramic. The use of these materials for the jar 15 would tend to prohibit the molding of positive interlocking connections between the stem assembly and base assembly (see FIG. 1). As a result, the user is left with an weak attachment between the two (i.e. the sealing plug 38), which can let loose and result in the base jar 15 being broken.

What is needed, then, is an improved hookah pipe that includes structure for creating a positive interlock between the stem assembly and base assembly in order to protect the base assembly from releasing from the stem assembly when the user picks up the pipe by the stem assembly.

SUMMARY OF THE INVENTION

In light of the aforementioned problems associated with the prior devices and accessories, it is an object of the present invention to provide an Interlocking Hookah Pipe. The pipe should incorporate a positively-lockable interface between the stem assembly and the base assembly of a hookah pipe. The interlocking stem assembly should have an interlock element upon which are pins, channels or other interlocking features. The stem assembly should further have a sealing gasket to seal to the base assembly. The base assembly should have a shoulder insert that inserts into the glass base jar and is then adhered thereto. The shoulder insert should have interlocking features that cooperate with the interlocking features disposed on the stem assembly interlock element. The pins or channels creating the interlocking mechanism should be disposed on either the stem assembly or the shoulder insert.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Interlocking Hookah Pipe.

Figure 1:
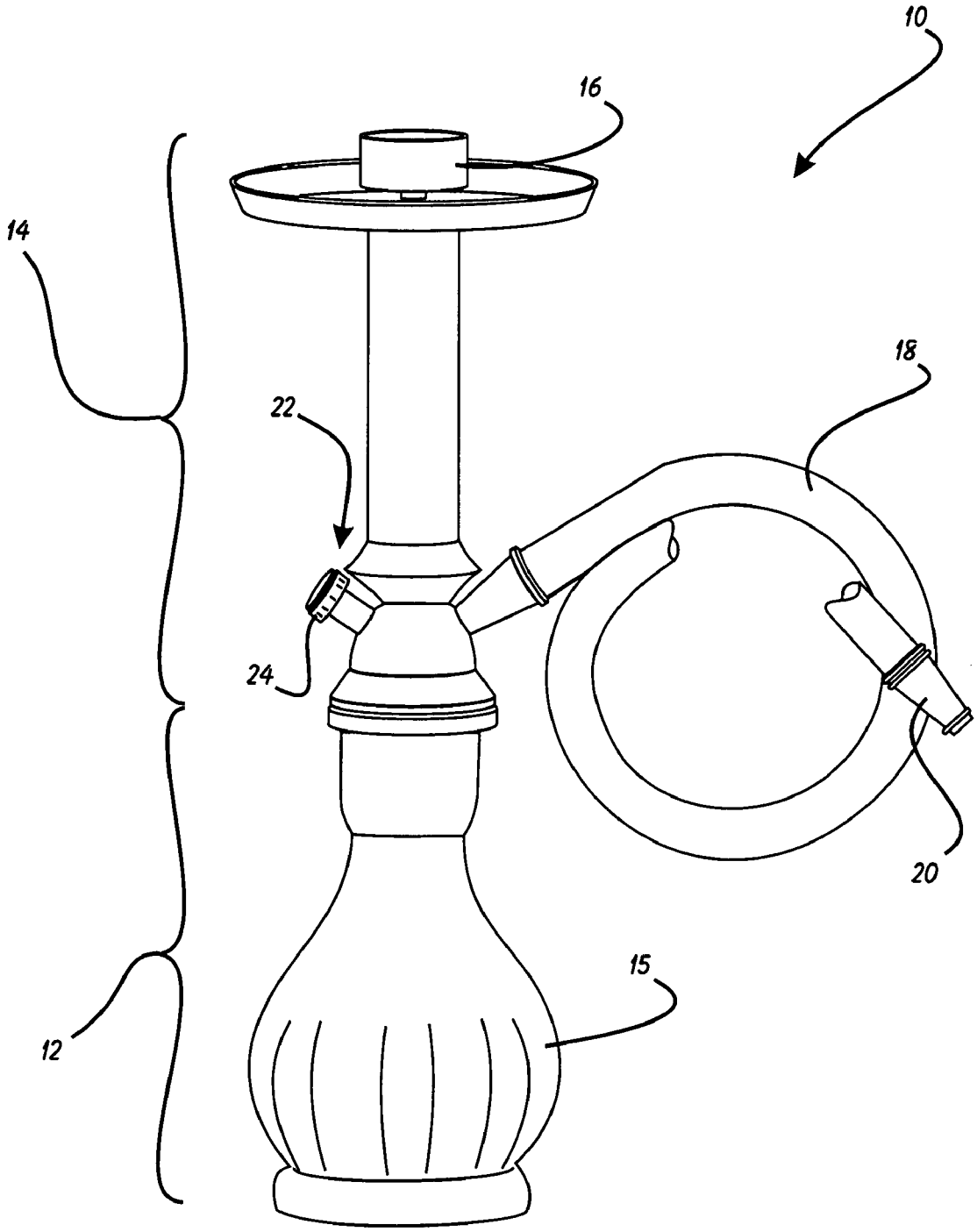
FIGURE 1 PRIOR ART
FIG. 1 is a perspective view of a conventional hookah pipe.
Figure 2:
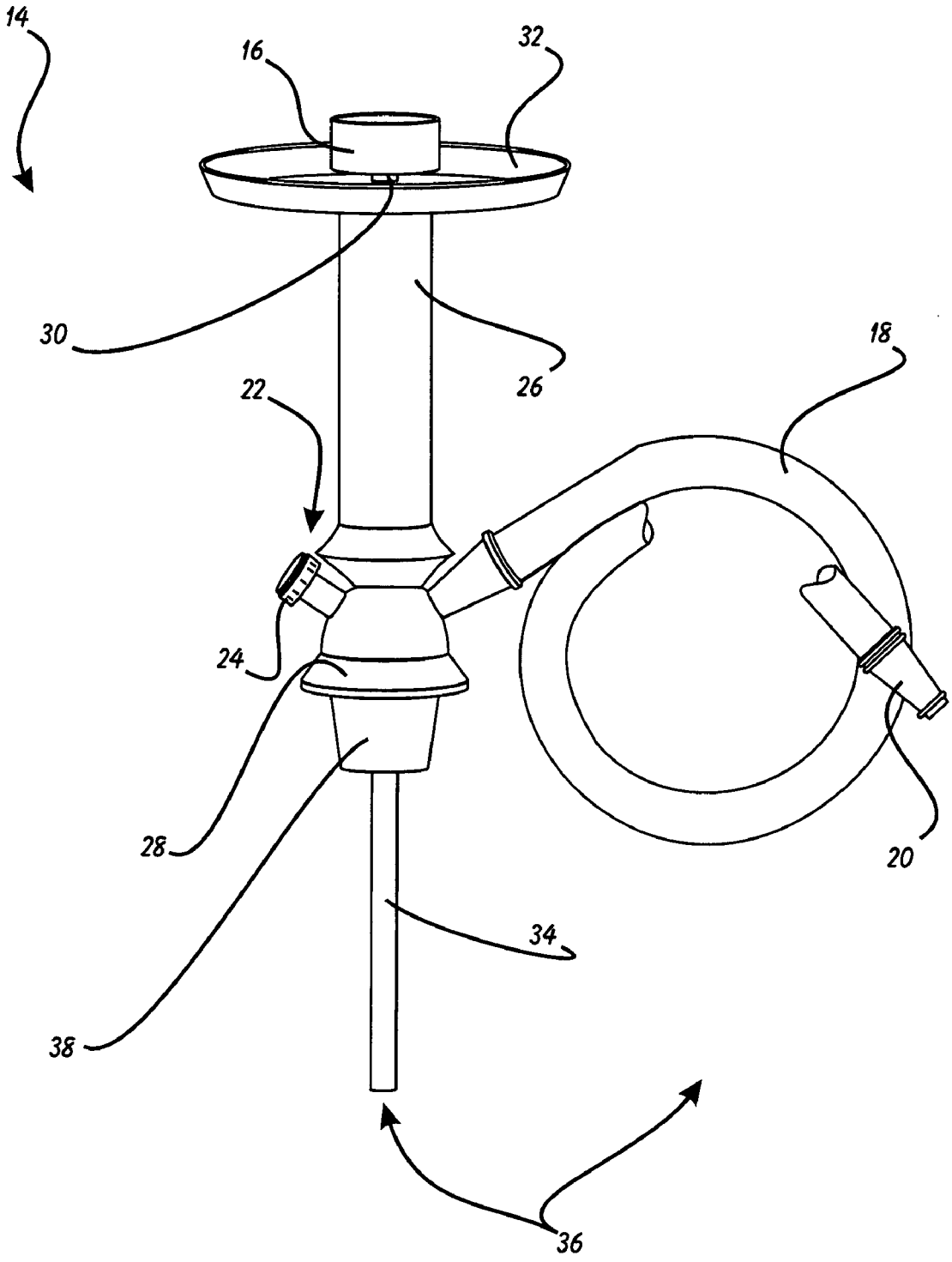
FIGURE 2 PRIOR ART
FIG. 2 is a perspective view of the stem assembly of the hookah pipe of FIG. 1.
Figure 3:
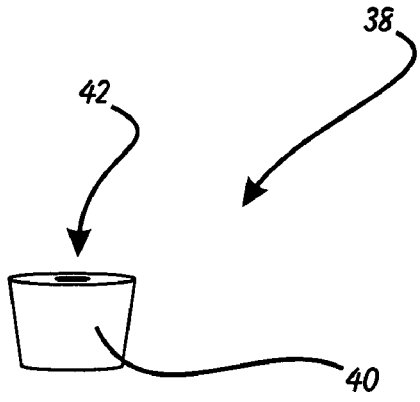
FIGURE 3 PRIOR ART
FIG. 3 is a perspective view of the sealing plug of the pipe of FIGS. 1 and 2.
Figure 4:
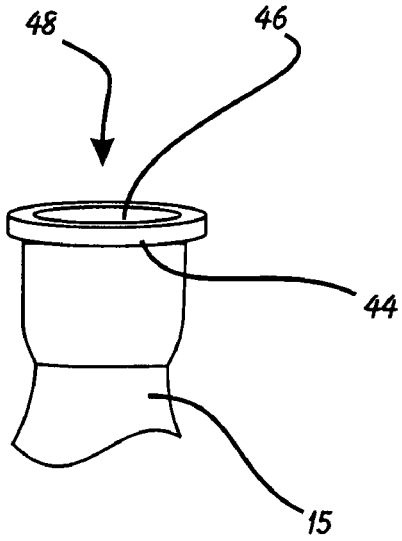
FIGURE 4 PRIOR ART
FIG. 4 is a partial perspective view of the base jar of the hookah of FIG. 1.
Figure 5:
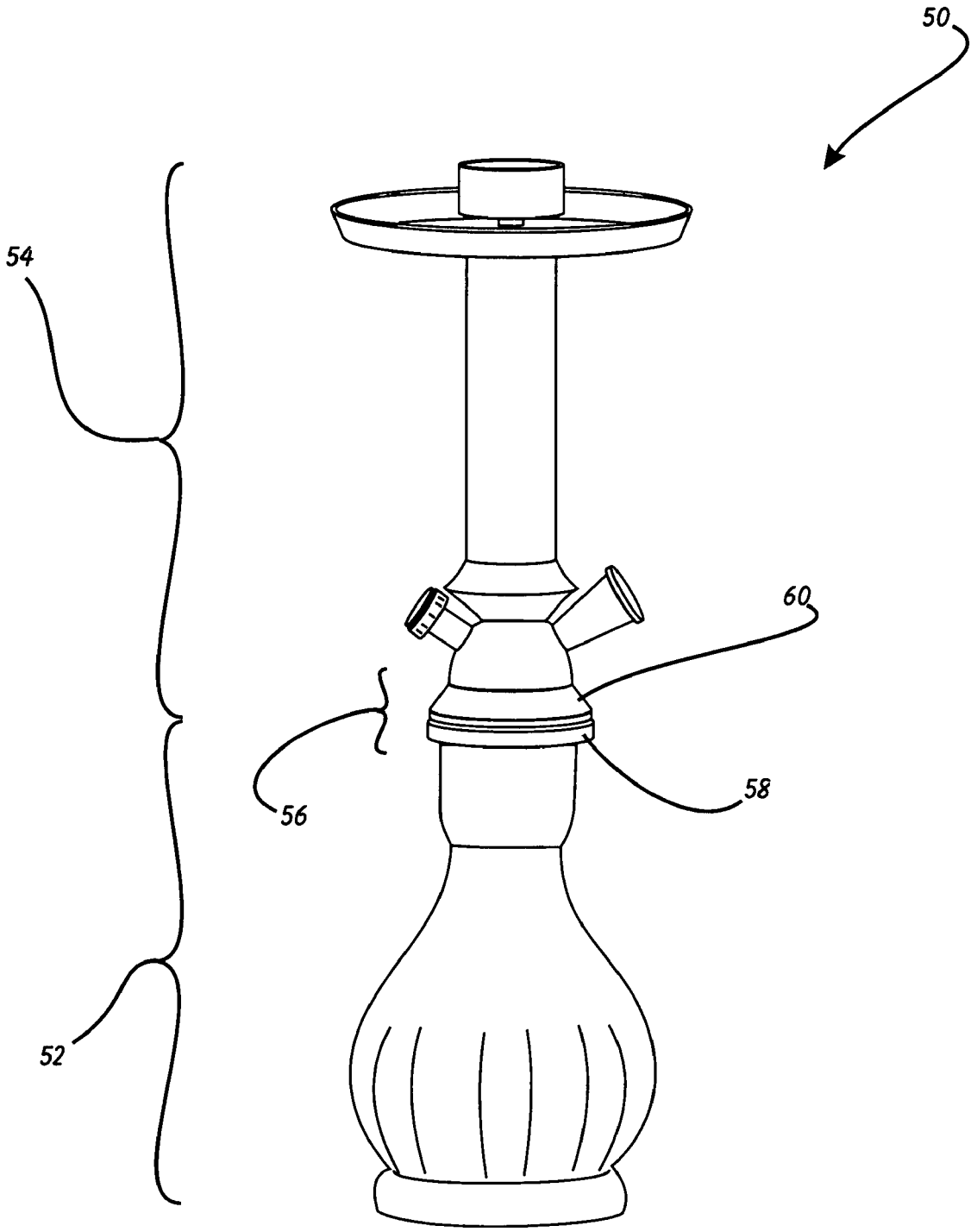
FIG. 5 is a perspective view of a preferred embodiment of the interlocking hookah pipe of the present invention.

The present invention can best be understood by initial consideration of FIG. 5. FIG. 5 is a perspective view of a preferred embodiment of the interlocking hookah pipe 50 of the present invention. The pipe 50 has an interlocking base assembly 52 and an interlocking stem assembly 54. The key feature of the pipe 50 is the stem-to-base interlock 56. The interlock 56 is comprised of distinct cooperating features adjacent to the stem housing base 60 and the shoulder 58. Specific details are found below in FIG. 6.

Figure 6:
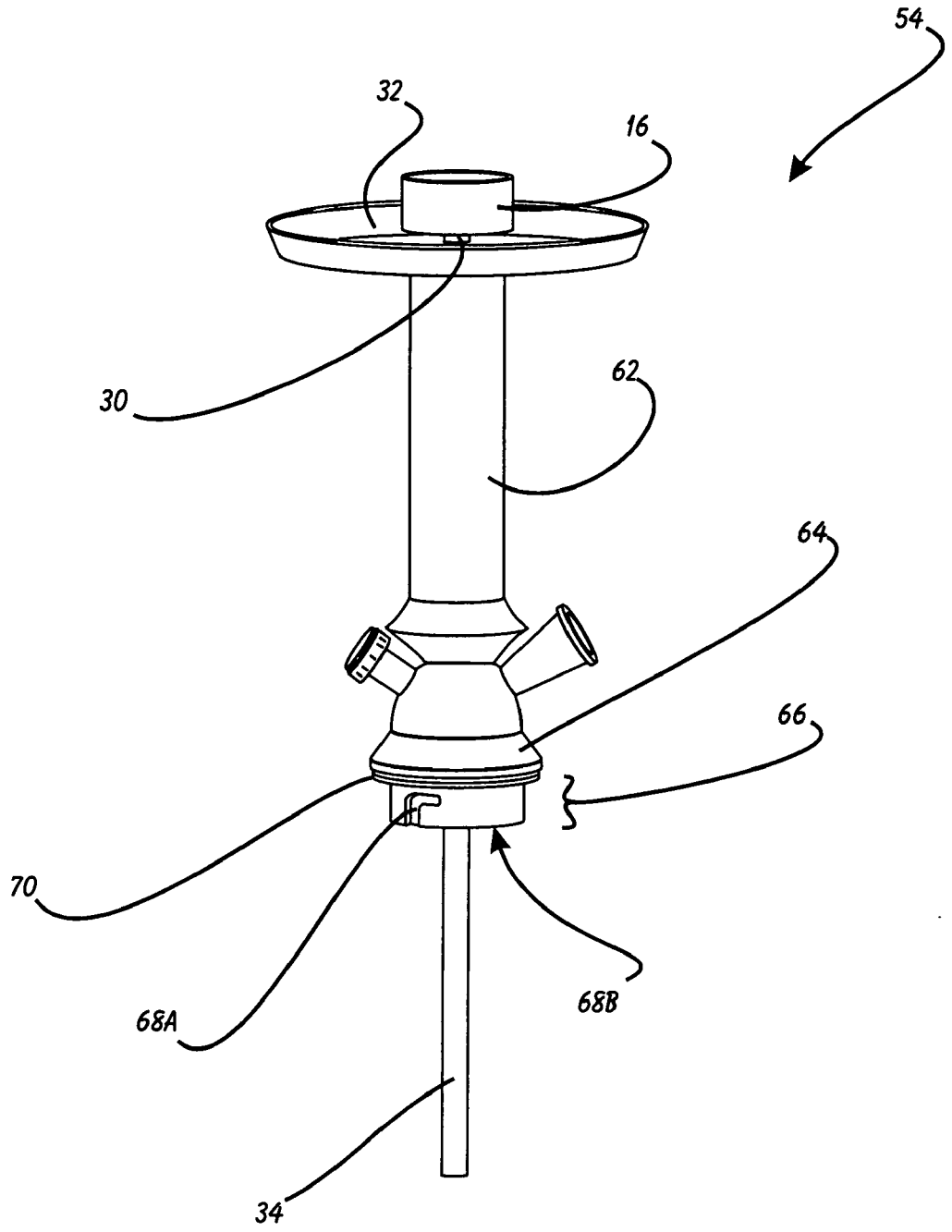
FIG. 6 is a perspective view of the interlocking stem assembly of the hookah pipe of FIG. 5.

FIG. 6 is a perspective view of the interlocking stem assembly 54 of the present invention. The assembly 54 is, in many ways, very similar to the conventional stem assembly discussed above. There is a bowl 16, a bowl stem 30, a charcoal plate 32 and a stem housing 62 defined by a stem housing base 64. What is unique is the stem interlock element 66 extending downwardly from the base 64 of the stem housing 62.

The stem interlock element 66 is a generally cylindrical protrusion from the bottom of the base 64. The water stem 34 extends through the bottom face of the stem interlock element 66.

In the depicted version, the stem interlock element 66 has first channel 68A and second channel 68B cut or formed within it. The channels 68A, 68B are generally L-shaped so that cooperating pegs extending from the interlocking base assembly will first slide longitudinally into the channels 68A, 68B, and then will lock the two assemblies 52, 54 together with a simple twisting action between the two assemblies 52, 54.

Figure 7A:
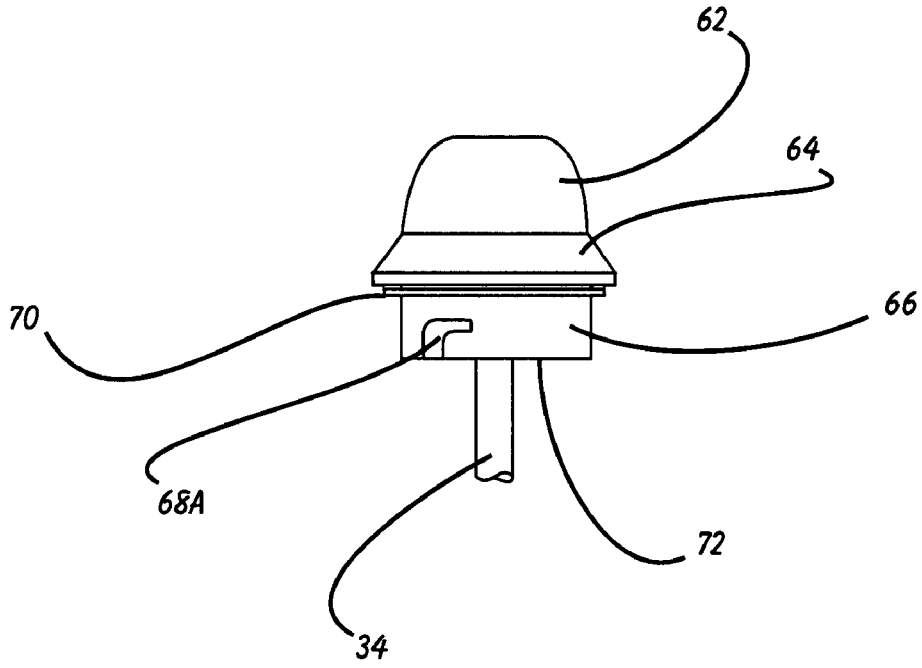
FIGS. 7A and 7B are a partial side view and a bottom view of the stem assembly of FIG. 6.
Figure 7B:
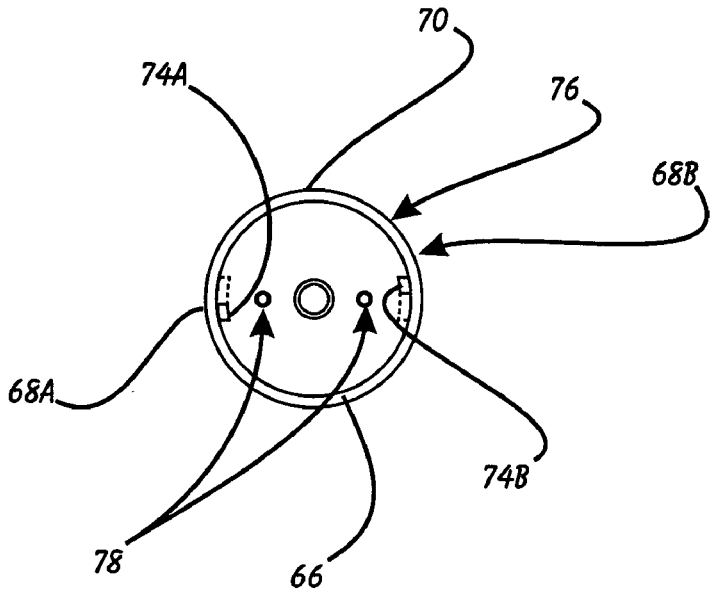

A generally circular, flat polymer sealing ring 70 is located at the extreme top of the stem interlock element 66 to provide an air-tight seal between the interlocking base assembly (see FIG. 5) and the stem housing base 64. FIGS. 7A and 7B provide additional specific detail regarding this structure.

FIGS. 7A and 7B are a partial side view and a bottom view of the stem assembly of FIG. 6. The sealing ring 70 can be seen to encircle the cylindrical stem interlock element 66 and abut the flattened bottom surface of the base 64 of the stem assembly. Furthermore, the bottom surface 72 has a plurality of suction apertures 78 formed therein through which smoke will be drawn by the user sucking on the mouthpiece (see FIG. 5).

In this version, only two channels 68A, 68B are formed in the sidewall 76 of the interlock element 66, however, in other versions three or more channels may be provided to give the interlock additional strength. Each channel 68A, 68B terminates in a notch 74A, 74B formed in the bottom face 72 of the element 66. As will become apparent by consideration of FIG. 8, it is through these notches 74A, 74B that the pegs extending from the throat of the interlocking base assembly will slide into the channels 68A, 68B to provide the interlocking action between the assemblies. As mentioned earlier, the interlock element 66 is generally constructed from a durable, strong material, such as aluminum or other metal. The sealing ring 70 is pliable rubber or equivalent material.

Figure 8:
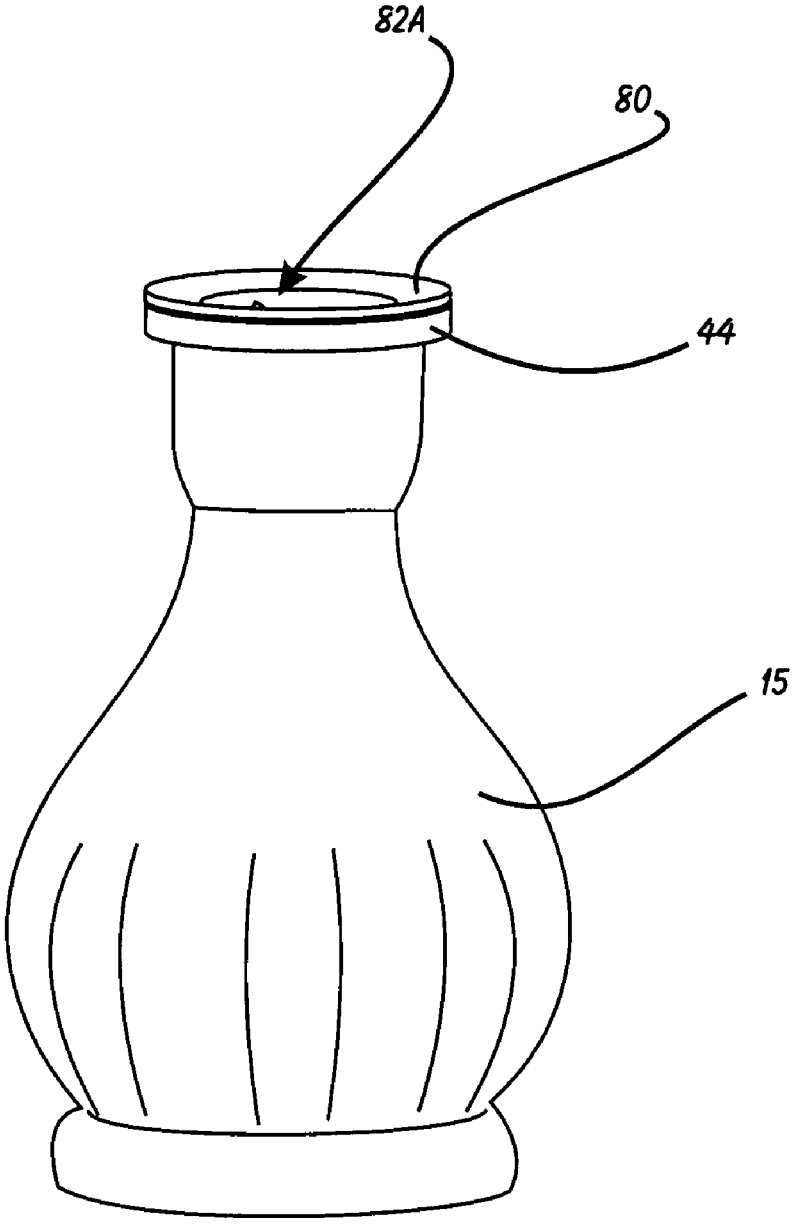
FIG. 8 is a perspective view of the interlocking base assembly of the hookah pipe of FIG. 5.
Figure 9:
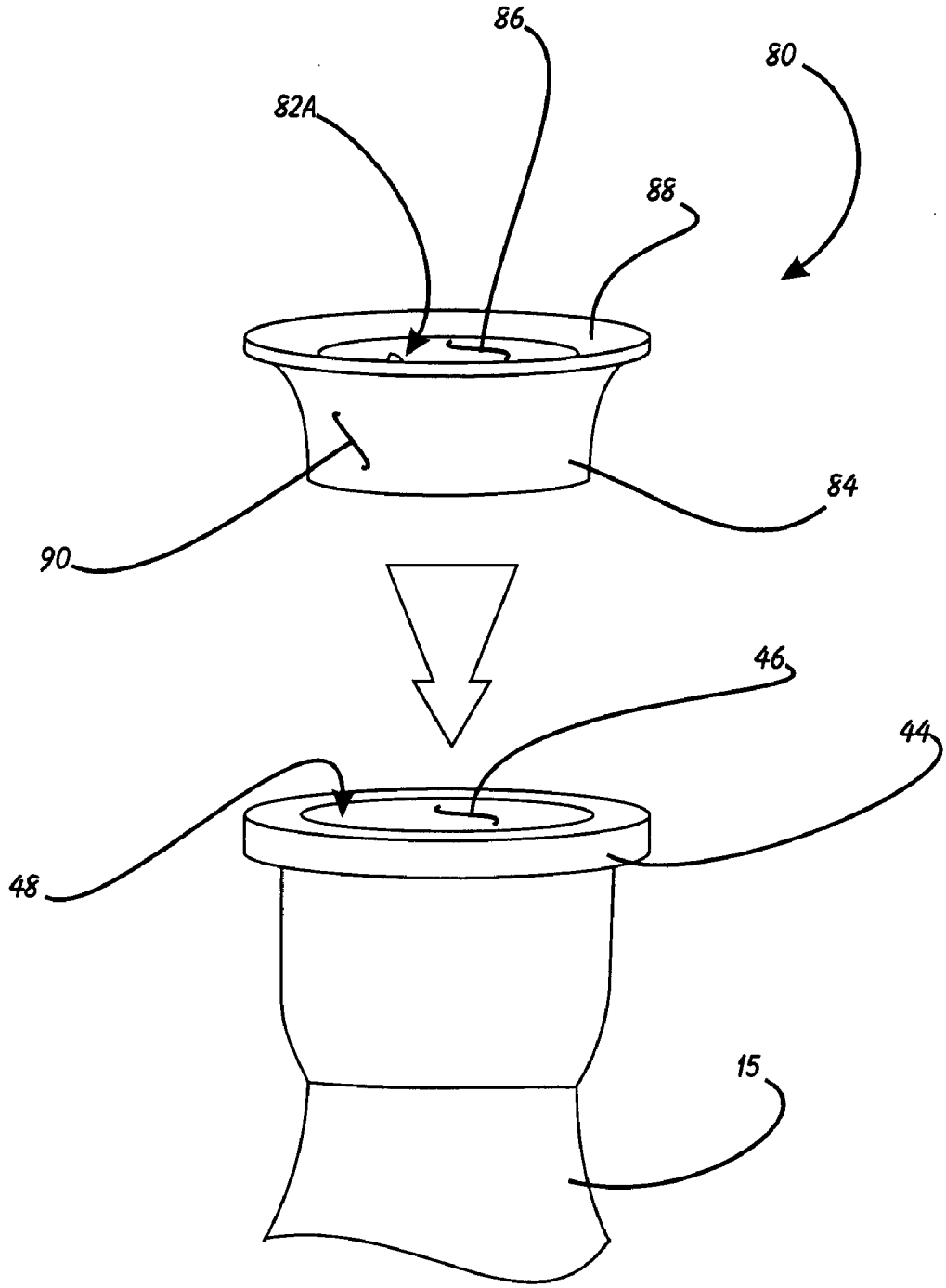
FIG. 9 is an exploded partial perspective view of the base assembly of FIG. 8.

FIG. 8 is a perspective view of the interlocking base assembly 52 of the hookah pipe of FIG. 5. The base assembly 52 comprises a base jar 15, made from the conventional materials such as glass, plastic or ceramics. The jar 15 terminates in a shoulder 44 at its upper end, similar to the conventional pipe discussed above. What is unique to the present invention is the shoulder insert 80. The shoulder insert 80 is typically a metallic part that is glued or otherwise bonded to the inner surface of the shoulder 44 area of the base jar 15. There are a plurality of interlock pegs (e.g. 82A) extending inwardly from the inner bore of the shoulder insert 80. The pegs (e.g. 82A) are positioned to cooperate with the channels formed in the interlocking stem element such that the stem element will slide into the shoulder insert 80 and then lock thereto with a partial twist between the two assemblies. FIG. 9 provides additional detail regarding the base assembly 52.

FIG. 9 is an exploded partial perspective view of the base assembly of FIG. 8. As one can readily see, the shoulder insert 80 is a generally mushroom-shaped element defined by a tubular throat section 84, which spreads out at its top end to form a sealing rim 88. The insert 80 forms an insert throat 86, which is actually the surface from which the pegs (e.g. 82A) protrude. The bottom of the sealing rim 88 and outside of the throat section 84 form a mating surface 90. The mating surface 90 is generally smooth and is formed to generally match the contour of the throat 48 of the base jar 15.

The throat section 84 is inserted into the top opening 47 of the base jar 15, usually after an adhesive material is applied to the mating surface 90 of the insert 80. The bottom surface of the sealing rim 88 will also be adhered to the top of the shoulder 44 so that the insert 80 will not inadvertently pull out or twist within the base jar 15. It is further noted that the sealing ring (see FIG. 7A) will seal against the top surface of the sealing rim 88 when the stem assembly and base assembly are twist-locked together. Finally, we shall turn to FIG. 10 to examine another version of the present invention.

Figure 10:
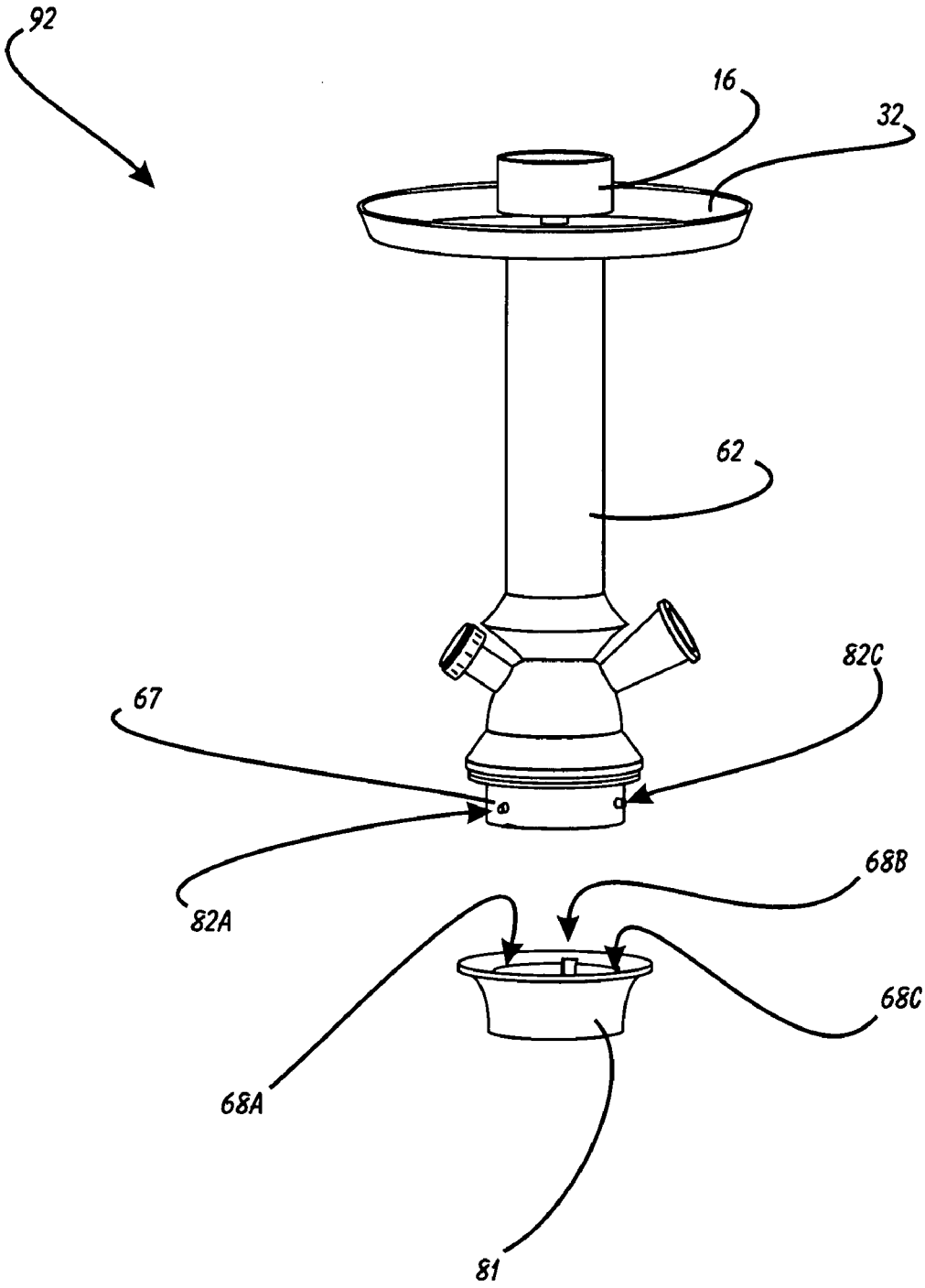
FIG. 10 is an exploded partial perspective view of the shoulder insert and stem assembly of the alternate embodiment of the interlocking hookah pipe of the present invention.

FIG. 10 is an exploded partial perspective view of the shoulder insert and stem assembly of the alternate embodiment of the interlocking hookah pipe 92 of the present invention. Here, the interlock pegs 82A, 82B (not shown) and 82C protrude from the stem interlock element 67 (rather than from the throat insert). Consequently, corresponding channels 68A, 68B and 68C are formed within the shoulder insert 81, rather than in the stem interlock element 67.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A hookah pipe, comprising:

a stem assembly comprising a bowl, a stem extending downwardly from said bowl, a stem housing partially encasing said stem, and an interlocking element;

said stem housing defining a bowl end adjacent to which said bowl is positioned, a bottom end from which said interlocking element extends, and a shoulder that is adjacent to said interlocking element and that defines a diameter that exceeds the diameter defined by said interlocking element;

a base jar comprising a throat configured to accept said interlocking element therein;

a thin sealing ring that encircles said interlocking element and is positioned between said base jar and a bottom surface of said stem housing shoulder when said interlocking element is inserted into said base jar throat; and whereby said interlocking element and said base jar throat are cooperatively configured such that a partial twist of said interlocking element relative to said base jar throat while said interlocking element is inserted within said throat will engage or disengage an interlock between said base jar throat and said interlocking element.

2. The hookah pipe of claim 1, wherein said base jar comprises:

a top opening formed in a base jar shoulder and a base jar throat accessible through said top opening; and a shoulder insert configured to insert within said base jar throat, said shoulder insert comprising said throat for interlocking with said stem interlock assembly.

3. The hookah pipe of claim 2, wherein said shoulder insert defines a throat section forming said throat and a sealing rim extending upwardly and outwardly from a top of said throat section, said throat section and said sealing ring comprising an outer mating surface having a contour designed to substantially match said base jar throat and base jar shoulder when said shoulder insert is inserted into said base jar throat.

4. The hookah pipe of claim 3, wherein said sealing ring is disposed between said stem housing shoulder and said sealing rim.

5. The hookah pipe of claim 4, wherein said stem interlock element defines a sidewall, said sidewall comprising at least two channels disposed in spaced relation therein, each said channel in communication with a notch formed in a bottom face of said interlock element; and said throat is defined by an inner surface having at least two pegs protruding inwardly therefrom and each cooperatively designed to insert into one said channel through its associated bottom face notch when said interlock element is inserted into said base jar throat.

6. The hookah pipe of claim 4, wherein said stem interlock element defines a sidewall, said sidewall comprising at least two pegs extending outwardly therefrom in relative spaced relation; and said throat inner surface is defined by at least two channels formed therein in relative spaced relation whereby each said peg engages one said channel when said stem interlock element is inserted into said throat.

7. An interlockable hookah pipe assembly, comprising:

a stem assembly comprising a water stem extending downwardly from an interlock element, said interlock element defined by an outer surface having at least two channels formed therein in spaced relation;

a base jar having a throat configured to accept said interlock element therein, said throat having an inner surface defined by at least two pegs extending inwardly therefrom, each said peg cooperatively positioned to engage one said channel when said stem assembly is inserted into said throat; and wherein said base jar comprises a material selected from the group of materials including glass, plastic, and ceramic, and said base jar throat includes a throat insert inserted into said base jar throat and attached thereto with adhesive material.

8. The interlockable hookah pipe assembly of claim 7, wherein said throat insert comprises said at least two pegs extending inwardly therefrom, and said base jar throat has a substantially smooth surface.

9. The interlockable hookah pipe assembly of claim 8, wherein said stem interlock element comprises a generally cylindrical shape defined by said channels formed on said outside surface thereof and further comprising a bottom face having said water stem extending downwardly therefrom.

10. The interlockable hookah pipe assembly of claim 9, further comprising a sealing ring disposed about said stem interlock element such that it is confined between a shoulder formed in a stem housing adjacent to said stem interlock element and said throat insert.

11. An interlockable hookah pipe assembly, comprising:

a base jar having a throat, said throat having an inner surface defined by two or more channels formed therein in relative spaced relation;

a stem assembly comprising a water stem extending downwardly from an interlock element, said interlock element configured to be insertable within said base jar throat and further defined by at least two pegs extending from a side wall of said interlock element, each said peg configured to engage one said channel when said interlock element is inserted into said throat; and wherein said base jar comprises a material selected from the group of materials including glass, plastic, and ceramic, and said base jar throat includes a throat insert inserted into said base jar throat and attached thereto with adhesive material.

12. The interlockable hookah pipe assembly of claim 11, wherein said throat insert comprises said at least two channels formed therein, and said base jar throat has a substantially smooth surface.

13. The interlockable hookah pipe assembly of claim 12, wherein said stem interlock element comprises a generally cylindrical shape defined by said pegs extending from said outside surface thereof and further comprising a bottom face having said water stem extending downwardly therefrom.

14. The interlockable hookah pipe assembly of claim 13, further comprising a sealing ring disposed about said stem interlock element such that it is confined between a shoulder formed in a stem housing adjacent to said stem interlock element and said throat insert.

* * * * *